United States Patent [19]

Knapp

[11] 4,406,406

[45] Sep. 27, 1983

[54] LIQUID METERING AND DISPENSING APPARATUS

[76] Inventor: Philip B. Knapp, 40 Reyam Rd., Lynbrook, N.Y. 11563

[21] Appl. No.: 243,377

[22] Filed: Mar. 13, 1981

[51] Int. Cl.[3] ..... B05B 7/32

[52] U.S. Cl. ..... 239/313; 137/564.5; 239/322; 239/323

[58] Field of Search ..... 239/310, 315, 317, 318, 239/322, 323, 327, 329, 313; 222/129.2; 137/101.11, 564.5

[56] References Cited

U.S. PATENT DOCUMENTS

| | | | |
|---|---|---|---|
| 1,006,016 | 10/1911 | Spayd et al. | 137/564.5 |
| 2,153,240 | 4/1939 | Dailey et al. | 239/310 |
| 3,166,096 | 1/1965 | Lang | 239/323 |
| 3,556,141 | 1/1971 | Hind | 137/564.5 |
| 3,608,829 | 9/1971 | Forsman | 239/317 |
| 3,720,230 | 3/1973 | Stockstill et al. | 137/564.5 |
| 3,974,847 | 8/1976 | Hodges | 137/564.5 |
| 4,023,778 | 5/1977 | Joly et al. | 239/310 |

FOREIGN PATENT DOCUMENTS

| | | | |
|---|---|---|---|
| 2019235 | 10/1979 | United Kingdom | 137/564.5 |

*Primary Examiner*—John J. Love
*Assistant Examiner*—Michael J. Forman
*Attorney, Agent, or Firm*—Edward F. Levy

[57] ABSTRACT

Apparatus for spraying plants with liquid treatment chemical such as an insecticide, fungicide, herbicide or the like, includes a reusable container having inlet and outlet hose connections, and a disposable cartridge which is inserted into the container. The cartridge comprises a pressure-sensitive container in the form of a piston cylinder or a collapsible bag containing the liquid chemical, and is mounted within a rigid casing or jar communicating with a stream of water under pressure entering the inlet hose connection. The stream of water also flows through an axial bore in the head of the reusable container to the outlet hose connection, passing from a high pressure side through a mixing chamber to a low pressure side. The pressure sensitive container has a precisely-dimensioned outlet aperture communicating with the mixing chamber so that liquid concentrate is forced under pressure from the pressure-sensitive container of the cartridge and mixes with the flow of water in a precise pre-selected micro-dispensing ratio, regardless of the pressure of the water supplied to the apparatus.

9 Claims, 7 Drawing Figures

LIQUID METERING AND DISPENSING APPARATUS

The present invention relates to a novel and improved apparatus for spraying plants with precisely-measured amounts of liquids such as herbicides, insecticides, fungicides or the like. The invention relates particularly to a prepackaged, disposable liquid dispensing system capable of supplying lawns, gardens, crops or the like with a treatment fluid in micro-dispensing amounts whenever treatment of the plants is required.

For dispensing insecticides or the like on plants, the chemical material is usually supplied in liquid or powdered form and is highly concentrated so that it must be diluted with water for application. The mixing of the concentrate with water presents serious difficulties to a home owner who finds it necessary to treat his lawn or garden, since it is burdensome and time consuming to mix the proper amount of concentrate, and very often too much mixture is made up, so that a large excess is wasted and must be discarded. It also often happens that the concentrate spills upon the hands of the user, causing burning or irritation of the skin, and leaving on the user's hands a highly toxic and dangerous chemical. In the instance where large areas of crops are to be sprayed with insecticides and the like, the chemical is supplied in highly-concentrated bulk form which must be diluted with large quantities of water. Normally, unskilled attendants are placed in charge of caring for the crops, so that the chemical concentrates are often spilled and wasted, and invariably the chemical is diluted in improper amounts, resulting in underdispensing of the chemical or an overdispensing which tends to damage the crops.

Recent studies have shown the desirability of supplying grass, plants, and other vegetation with chemical treatment liquids in micro-dispensing amounts, that is to say, minute amounts of chemical per million parts of water. Not only do these micro-dispensing amounts supply the optimum quantity of chemical to the vegetation, but they permit plant treatment to be accomplished simultaneously with the normal watering of the plants, by mixing the treatment chemical with the water supplied to a spray or sprinkler system.

An object of the present invention is to provide apparatus for dispensing liquid insecticide or similar liquid chemicals and applying it in micro-dispensing amounts to garden plants, crops or other vegetation. The apparatus includes a disposable cartridge containing the liquid in concentrated form and a reusable container for the cartridge containing means for metering the liquid chemical with the cartridge. The container is attachable to a source of water under pressure and is connected to a spray or sprinkler apparatus, with the liquid chemical being mixed with the stream of water flowing through the container.

In my copending U.S. patent application Ser. No. 144,851, filed Apr. 29, 1980 and entitled "Lawn and Garden Feeding Apparatus", now U.S. Pat. No. 4,340,179, I have disclosed an assembly for feeding fertilizer or other nutriments to lawns and gardens in micro-feeding amounts. This assembly includes a disposable cartridge containing concentrated nutriment suspended in a gel in solid form, and a container enclosing the cartridge and connected at one side to a source of water under pressure and at the other side to a nozzle or sprinkler apparatus. Water flowing through the container draws nutriment from the gel in micro-feeding amounts, and is discharged from the nozzle or sprinkler. The present invention provides an apparatus which also permits the use of a disposable cartridge mounted in a reusable container and is also insertible within a sprinkler system to feed a chemical concentrate to a stream of flowing water. In this instance, however, the assembly is adapted to meter concentrate in a liquid form, and particularly to dispense, in micro-dispensing amounts, insecticides and the like which are commercially available as liquid concentrates.

U.S. Pat. Nos. 2,571,424 issued Oct. 16, 1951; 2,153,240 issued Apr. 4, 1939; 3,155,113 issued Nov. 3, 1964; and 3,720,230 issued Mar. 13, 1973 show spray devices of various constructions for feeding liquid concentrates in proportionate amounts to a stream of flowing water, but none of these devices are adaptable for micro-dispensing of liquid concentrate for plant treatment, and none provides a precise pre-selected mixing ratio of the liquid concentrate regardless of the pressure of the water stream provided.

Another object of the invention is to provide apparatus for dispensing liquid insecticides or similar liquid concentrates which is capable of automatically mixing with flowing water any desired liquid at a ratio of minute parts per million and within a range, for example, between 200 parts of liquid concentrate per million parts of water, and 4,000 parts per million (PPM). The apparatus is capable of feeding liquid at the same PPM ratio throughout the life of the contained disposable cartridge, and regardless of variations in the water pressure employed or of water pressure changes occuring during operation of the apparatus.

Another object of the invention is the provision of apparatus of the type described which is capable of receiving prepackaged disposable cartridges containing liquid concentrate, which cartridges are capable of being re-capped after partial use, so that they may be stored for subsequent re-use. The apparatus is adapted to receive cartridges of different size and content volume so that the same dispenser apparatus may be used to dispense one pint of liquid concentrate or more, or as little as one ounce of concentrate. The cartridge itself is constructed to dispense its contained liquid precisely at a predetermined PPM ratio, and in such a manner that the selected PPM ratio cannot be adjusted or accidentally varied by the user.

Still another object of the invention is the provision of apparatus of the character described which may be used either with a hand-held nozzle, attached to a sprinkler system for lawns and gardens, or incorporated within a central watering system for crops or the like.

Another object of the invention is the provision of apparatus of the type described in which the disposable cartridge is prepackaged with liquid concentrate at the manufacturing plant and may be easily inserted into and removed from the dispenser portion of the apparatus without the user contacting the liquid concentrate contained within the cartridge.

A further object of the invention is the provision of apparatus of the character described in which the reusable dispenser portion of the apparatus is composed of a smaller number of parts and may be manufactured economically at such a reasonable cost that the apparatus is well within the purchasing range of the average home owner.

In accordance with the invention, there is provided liquid concentrate diluting and feeding apparatus comprising a dispenser member and a disposable cartridge removably mounted on said dispenser member, said cartridge comprising a pressure-sensitive container containing a supply of liquid concentrate and having an outlet aperture. The dispenser member comprises a metering head with a hollow casing removably mounted thereon. The metering head has a water inlet opening adapted to be connected to a source of water under pressure, a water outlet opening adapted to be connected to water discharge means, and a water conduit interconnecting the inlet and outlet openings and comprising a through bore having a high pressure end communicating with said inlet opening, a low pressure end communicating with said outlet opening, and a mixing chamber between the low pressure end and high pressure end. The metering head also has a first auxiliary fluid conduit communicating with the high pressure end of said through bore and with the interior of said hollow casing, a second auxiliary fluid conduit communicating with the mixing chamber, and means for mounting said disposable cartridge thereon with the pressure-sensitive container suspended within the hollow casing and with said outlet aperture communicating with the mixing chamber through the second auxiliary fluid conduit.

In use, water under pressure from the water source flows in a first path through the water conduit and through the mixing chamber thereof to the water outlet opening, and in a second path to the interior of said hollow casing, thereby filling the latter and surrounding the pressure-sensitive container of the disposable cartridge, thereby feeding the contained liquid concentrate therein through the outlet aperture into the mixing chamber, where the concentrate mixes with the stream of flowing water. The outlet aperture is sized to dispense liquid concentrate for mixing with the stream of water flowing in said first path through the mixing chamber in a precise, pre-selected micro-dispensing amount of parts of concentrate per million parts of water, regardless of variations in the pressure of the water supplied from the water source.

Additional objects and advantages of the invention will become apparent during the course of the following specification when taken in connection with the accompanying drawings, in which.

Figure 1:
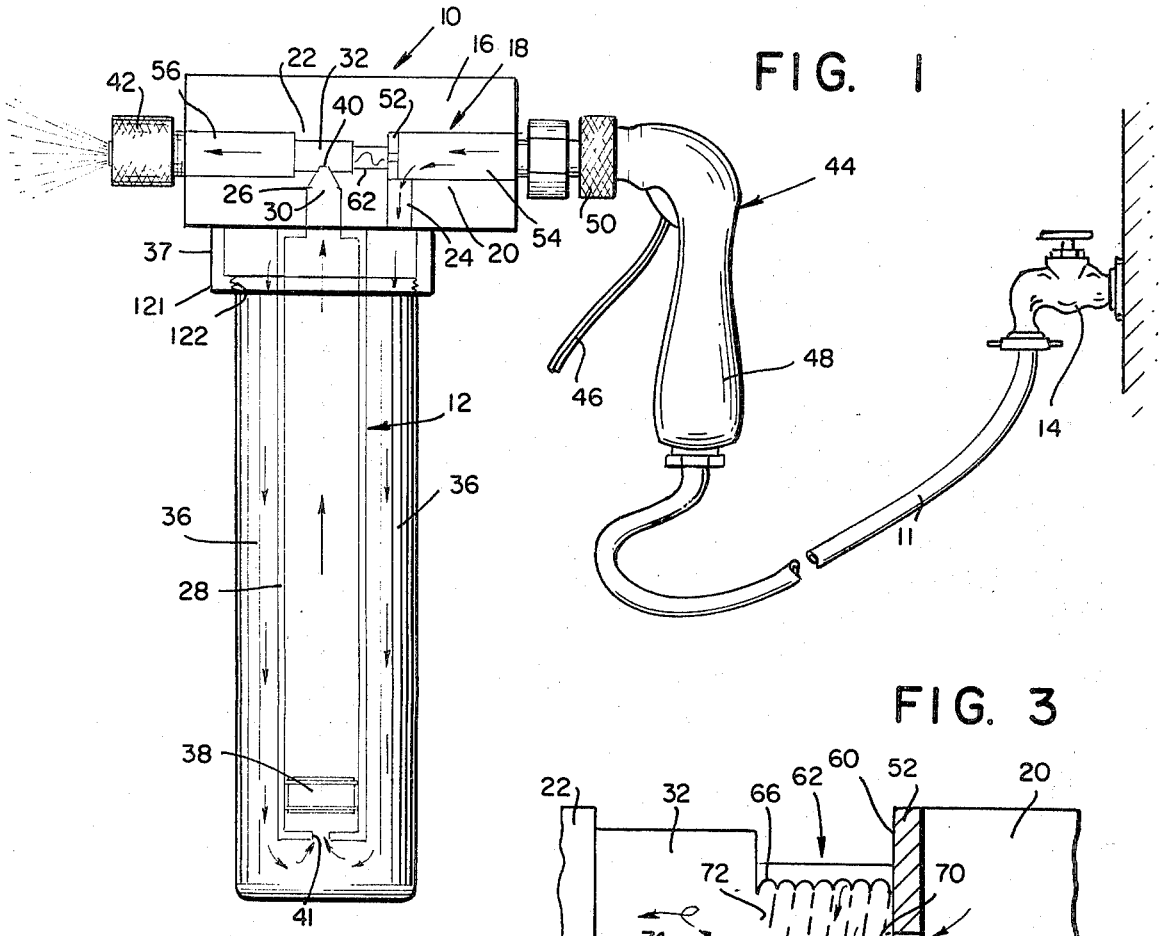
FIG. 1 is an elevational view of a metering and dispensing assembly made in accordance with the present invention, showing the assembly connected to a water faucet.

Referring in detail to the drawings, and in particular to FIG. 1, there is illustrated a fluid dispensing assembly made in accordance with the present invention, and generally comprising a dispenser member 10 to which a disposable cartridge 12 is removably attached. The dispenser member is illustrated as a manually-operable hand-held sprinkler device and is attached to the outlet end of a garden hose 11 connected to a supply of water under pressure, for example, a water tap or faucet 14.

The fluid dispensing assembly is adapted to spray plants, trees and other forms of growing vegetation with beneficial treatment materials in liquid form, for example, a fertilizer, insecticide, or the like, diluted with water in exact proportions. The insecticide or other treatment material is supplied in concentrated form within the disposable cartridge 12, and when the latter is attached to dispenser member 10 and the faucet is opened to cause a stream of water to flow through the dispenser member, the insecticide contained in the cartridge is injected into the water stream in precise constant amounts, in a manner to be presently described.

The dispenser member 10 includes a fluid metering head 16 in the form of a rectangular block which is preferably made of a rigid plastic. The head has a longitudinal main bore 18 extending centrally therethrough and constituting a conduit for the flow of water from the faucet 14 and hose 11. The bore 18 is of a non-uniform diameter which provides a high pressure side 20 and a low pressure side 22, with an intermediate mixing chamber 32 of smaller diameter at said low pressure side. A first auxiliary fluid conduit in the form of a bore 24 extends perpendicularly to the main bore 18 and communicates therewith at the high pressure side thereof. A second auxiliary fluid conduit in the form of a bore 26 is also perpendicular to main bore 18 and communicates with the latter at the low pressure side thereof. The bore 26 is sized and shaped to receive and mount the disposable cartridge 12, as will be presently described.

Figure 2:
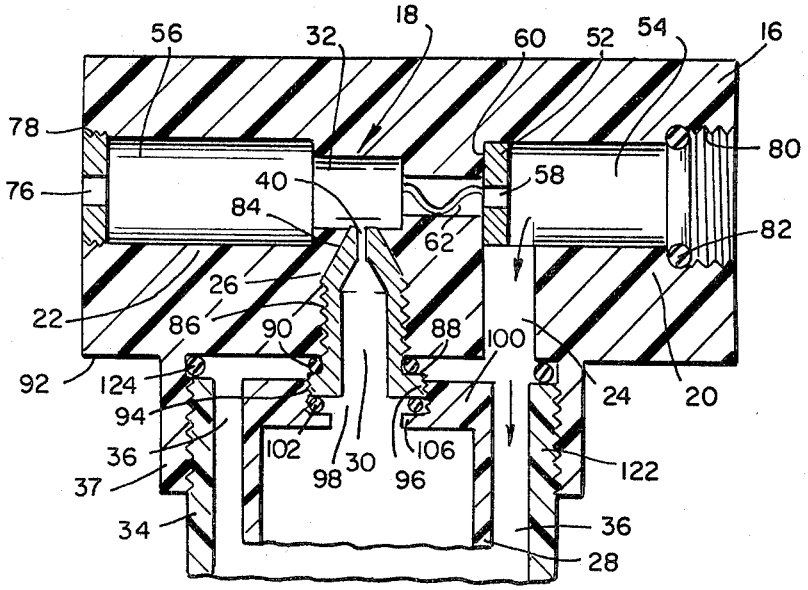
FIG. 2 is an enlarged sectional view of the dispensing member of the assembly, and of a portion of the disposable cartridge attached thereto.

The disposable cartridge 12 comprises a pressure-sensitive container 28, which, in the embodiment shown in FIGS. 1–4, is in the form of a piston cylinder containing a liquid chemical. The cylindrical container is preferably made of a transparent rigid plastic, and has at one end a plug or nozzle 30 which is externally threaded as shown at 31 for removable reception within the bore 26 which is internally threaded. The nozzle 30 has a frustoconical end portion, in the tip of which is a small orifice 40. When the container 28 is mounted in operative position, as shown in FIG. 2, the orifice 40 communicates with the interior of the main bore 26 for injecting the liquid content of the container 28 into the stream of water flowing through the main bore 26. At its bottom end, the container 28 is formed with a large inlet opening 41, and a slidable piston 38 overlies this inlet opening 41.

The cartridge 12 is supplied as a disposable unit and contains a liquid chemical to be dispensed. The liquid chemical is preferably an insecticide or fungicide, but may also be a fertilizer or other liquid for treating growing plants.

The dispenser member 10 also includes an enclosed cylindrical pressure casing or jar 34 having a threaded top end 35. The fluid metering head 16 is formed with an integral depending annular flange 37 which is internally threaded for removably receiving the threaded top end of the pressure casing 34. When the pressure casing 34 is screwed into mounted position on the flange 37, it surrounds and encloses the cartridge 12 and also communicates with the auxiliary fluid conduit 24, as shown in FIG. 2.

When the dispensing assembly is to be used, the tap 14 is opened so that water under pressure flows through the hose 11 to the metering head 16. Water under pressure thus enters the bore 18 and flows from the high pressure side 20 to the low pressure side 22 via the mixing chamber 32. Upon entering the bore 18, a portion of the water stream is diverted into the interior 36 of the pressure casing 34 by way of the first auxiliary fluid conduit 24 which constitutes a water duct, so that water fills the interior of the pressure casing 34, surrounds the cartridge 12, and enters the lower portion of the pressure sensitive container 28 thereof through the inlet opening 41. As will be appreciated, water under pressure flows from the fluid conduit 24 into the entire interior of pressure casing 34, and exerts an upwardly-directed fluid pressure upon the piston 38 of the piston cylinder 28 so that the pressure of the liquid chemical within the cylinder 28 is substantially identical to the surrounding pressure in the interior of casing 34, and thus equal to the pressure in the high pressure side of the main bore 18.

The fluid pressure exerted on the chemical within the cylinder 28 causes the chemical to be discharged therefrom via the orifice 40 in nozzle 30, which, in mounted position, is located within the second fluid passage 26, the latter constituting a chemical duct. Orifice 40 of discharge nozzle 30 communicates with the interior of the mixing chamber 32 and injection of the liquid chemical into the latter is at a predetermined rate depending upon the size of the orifice 40, as will presently be described.

Liquid flowing from the high pressure side 18 to the low pressure side 22 follows a flow path through the mixing chamber 32 where the contents of the cylinder 28 are admixed with the water passing through the chamber. In this manner, liquid chemical is forced from the piston cylinder 28 due to the differential pressure described, and is picked up by the water which passes through the axial bore 18. The liquid chemical, subsequently, is admixed and dissolved within the water and discharged from the metering head 16 via a spray nozzle 42. A manually-operable and trigger-actuated on/off valve mechanism, designated generally by the reference numeral 44, allows water to be supplied to the metering head 16. The actuating mechanism is seen to comprise the usual valve trigger 46 and a hand-gripping portion 48 having a configuration similar to a gun butt. A fitting 50 is provided to detachably connect the actuating mechanism 44 to the metering head 16.

To aid in the formation of high and low pressure section in the main bore 18, a flow restrictor 52 is provided toward the upstream end 54 of the bore 18, which arrangement is shown in detail in FIG. 2. The restrictor 52 is adapted to form a resistance to flow in the bore 18 and causes a substantial pressure drop between the pressure on the upstream side of the restrictor and the pressure on the down stream side toward bore end 56. The pressure at the upstream side of the restrictor 52 is referred to herein as the "higher pressure" and the pressure at the downstream side as the "lower pressure". The flow restrictor 52 is designed to allow quantity of flow per unit time to flow therethrough at a rate proportional to the pressure differential across the restrictor. The restrictor may be of any desired design to allow such proportional flow but in its preferred form is an annular disc of a suitable material as, for instance, a plastic having a central aperture 58. The restrictor 52 may, if desired, be anchored against longitudinal movement along bore 18 in the downstream direction by any desired means such as by a shoulder 60 in the bore 18.

Figure 3:
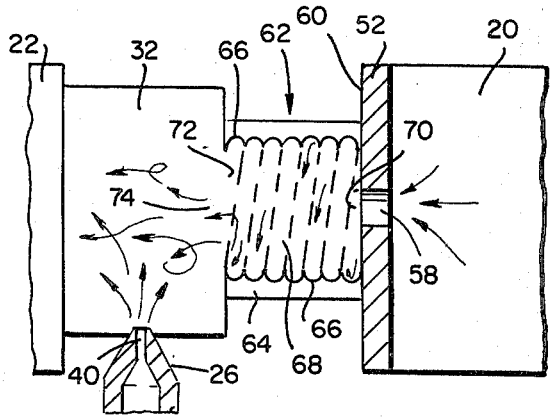
FIG. 3 is an enlarged fragmentary sectional view of the mixing chamber portion of the dispensing member shown in FIG. 2.

As shown in FIG. 3, between the restrictor 52 and the mixing chamber 32, is a helical flow path 62 for the water passing from the aperture 58 of the restrictor 52 toward the low pressure side of the bore 18. The flow path 62 is formed by an outer substantially cylindrical shell 64 having one or more helical grooves 66 formed in its inner periphery. The grooves 66 extend like threading from the top to bottom of shell 64 and have a predetermined cross section. Adapted to fit in the chamber defined within the shell 64 is a block 68. The block 68 is shaped to abut the inner periphery of shell 64 with a fit which is sufficiently tight to avoid any leakage between block 68 and shell 64, except for the passage provided by the helical grooves 66. One end 70 of the grove 64 is aligned with the aperture 58 of the restrictor 52. The second opposite end 72 terminates at the opening 74 through which the flow path 62 communicates with the mixing chamber 32. In this manner, the water flowing along the helical groove or grooves are forced to follow a substantially sinuous passage which, upon exiting from the flow path 62, creates whirling and turbulence of the water in mixing chamber 32. This turbulence has been found to facilitate the admixing of the liquid chemical and water supplied to the mixing chamber 32. In addition, the whirling or turbulent water provides a back pressure within the mixing chamber 32 to ensure that the quantity of liquid chemical flow into the chamber 32 is kept constant and is maintained at the desired proportionate ratio.

At the discharge or downstream end 56, the bore 18 is formed with a flow restriction in the form of aperture 76. The diameter of aperture 76 is identical to that of aperture 58 in restrictor 52 and, likewise, its flow output is proportional to that of aperture 58. The bore end 56 is internally threaded at 78, FIG. 2, to receive the spray nozzle 42.

The main bore 18, at its inlet end 80 at the high pressure side 16, is internally threaded to receive the fitting 50 of the water-actuating mechanism 44. Further provided in this bore end is a compressible O-ring 82, or similar sealing element to position the mechanism in the bore in a leak-proof manner.

Figure 4:
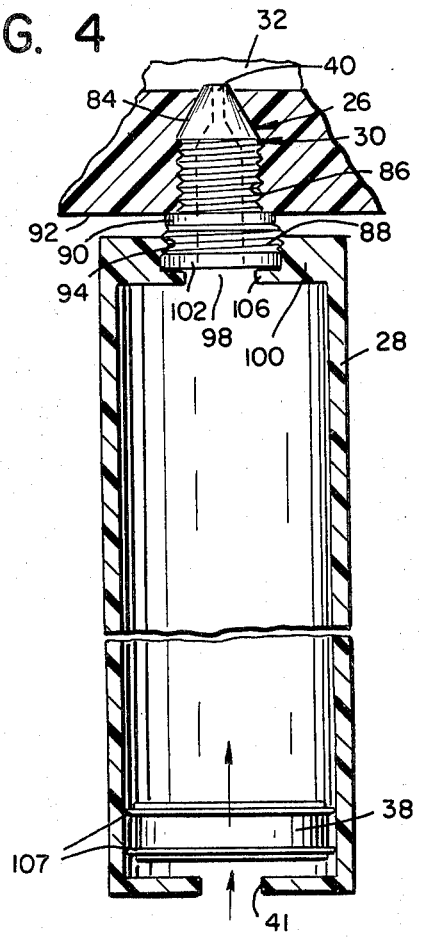
FIG. 4 is a sectional view of the disposable cartridge shown in FIG. 1.
Figure 5:
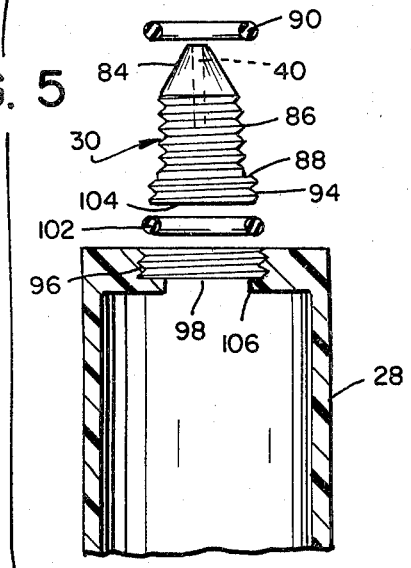
FIG. 5 is a partial sectional view of the cartridge, similar to FIG. 4, but showing the cartridge nozzle portion in exploded condition.

As is clearly shown in FIGS. 2, 4 and 5, the nozzle or plug 30 which is screw-mounted within the chemical duct 26, fits snugly and precisely within the defining surfaces of this duct. The socket or duct 26 has an inner configuration identical to the outer configuration of the nozzle 30. The nozzle 30 is formed with upper tapering walls 84, externally threaded side walls 86, and a base in the form of a shoulder flange 88. The chemical discharge orifice 40 extends through the tapering walls 84 and in the arrangements shown, communicates with the interior of the mixing chamber 32 and with the interior of the pressure-sensitive container 28. The nozzle 30 is threadably received or screw mounted in the bore which defines the chemical duct 26. To mount the nozzle 30 in a leak-proof manner, an O-ring 90 is provided and compressed between the shoulder 88 of the nozzle and the lower housing surface 92 of the metering head 16.

The base or shoulder flange 88 of nozzle 30 is provided with external screw threading 94 which is sized to fit internal threading 96 bordering a central opening 98 in the top wall 100 of the pressure-sensitive container 28. In assembly of the disposable cartridge 12 as a unitary structure, the nozzle 30 is sealingly secured to the container 28 by means of an O-ring 102 which is seated within the opening 98. When the nozzle 30 is screwed tightly into mounted position, the O-ring 102 is compressed between the under surface 104 of shoulder flange 88 and a shoulder 106 underlying the opening 98.

The piston 38, which affords compression of the liquid chemical contained in cylindrical container 28, is of the usual type and is provided with conventional compression rings 107 (FIG. 4).

Figure 6:
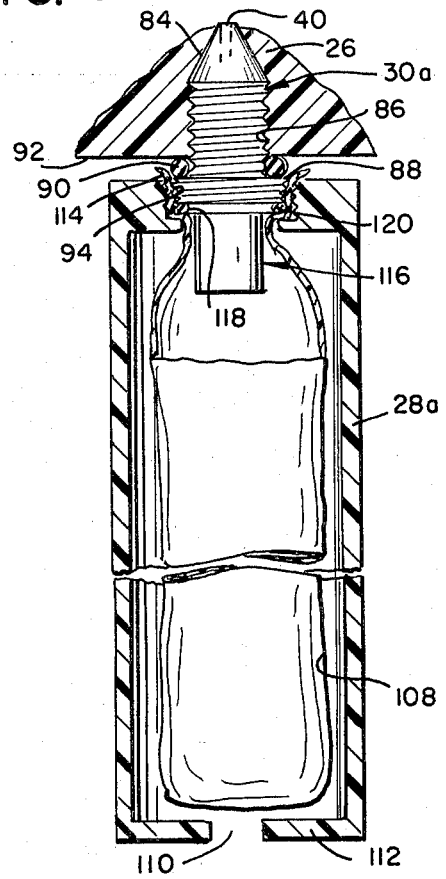
FIG. 6 is a sectional view of another embodiment of disposable cartridge which may be used in the assembly of the invention.
Figure 7:
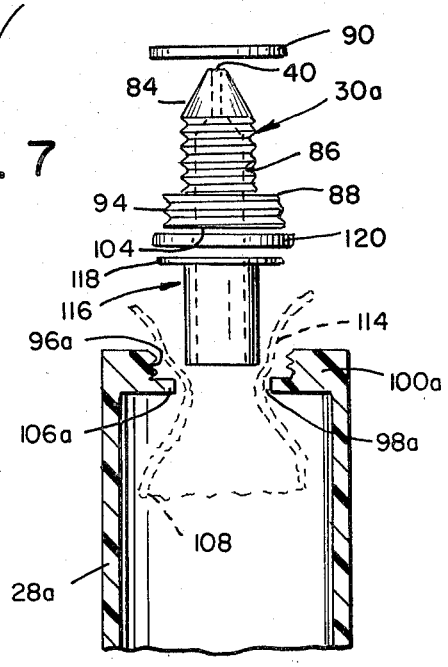
FIG. 7 is a partial sectional view of the cartridge of FIG. 6, showing the nozzle portion in exploded condition.

FIGS. 6 and 7 show a second embodiment of the invention in which the disposable rigid piston-cylinder 28 is replaced by a pressure-sensitive container in the form of a compressible bag 108 made of a thin, pliable material such as, for instance, rubber or a plastic material. The compressible bag 108 is positioned in upright position within an outer container 28*a*. The container 28*a* is identical to the container 28 shown in FIGS. 1 and 3, with the exception that water pressure exerted on the piston 38 is, in the arrangement shown, applied to the collapsible bag 108. For this purpose, water entering the interior 36 of pressure casing 34 via the water duct 24 flows under pressure into the cylindrical container 28*a* by way of an opening 110 in lower end 112 of receptacle 28*a*, FIG. 6. The bag 108 is placed under high pressure from the high pressure side 20 of the bore 18 and, as a result, the liquid chemical contained within the compressible bag 108 is deformed until the pressures of the chemical and water are substantially equal. At this time, the liquid chemical is discharged from the bag 108 via orifice 40 in nozzle 30. The chemical discharge, as in the first embodiment, is in the mixing chamber 32 where the chemical liquid is picked up and admixed with the water flowing through the main bore 18.

The manner in which the compressible bag 108 is detachably secured to the nozzle 30*a* is as follows: The bag 108 at its upper end 114, is initially extended through the opening 98*a* in the upper wall 100*a* of the container 28*a*. Subsequently, an annular sleeve member 116 is inserted through the opening 98*a* and in a manner such that the upper flange portion 118 of the sleeve 116 is seated in abutting engagement against the inwardly directed shoulder 106*a* formed in the bore 98*a* in the upper wall 100*a* of the container 28*a*. In this condition, the neck portion of the sleeve 116 extends downwardly into the bag 108 while the upper bag portion 114 is sandwiched between the sleeve flange 118 and the shoulder 106*a* within the bore 98*a*, FIG. 6. Presently, an O-ring 120, or similar sealing element, is positioned onto the flange portion 118. Finally, the container 28*a* is threadably secured to the shoulder flange 88 of the nozzle 30. The second O-ring 90 or similar sealing element is positioned and sandwiched between the shoulder flange 88 of the nozzle 30*a* and the under surface 92 of the metering head 16.

Once the pressure-sensitive container 28 of the first embodiment or the collapsible and compressible bag 108 of the second embodiment are detachably secured to the nozzle 30, the pressure casing 34 is detachably connected to the lower surface 92 of the metering head 16 by means of the internally-threaded depending annular flange 37, the inner diameter of which is slightly larger than the outer diameter of upper threaded end 122 of the casing 34 so as to provide a snug fit therewith. To provide a leak-proof sealing condition between the pressure casing 34 and the lower surface 92 of the metering head 16, an O-ring 124 is seated between the top end of the casing 34 and the bottom wall 92 of metering head 16.

In use of the fluid dispensing device, the user need only remove the casing or receptacle 34 from the metering head 16 and mount on the latter a chemical-filled disposable cartridge 12 by screwing the cartridge nozzle 30 into the threaded fluid passage 26 of the metering head. The cartridge may be either the piston-type shown in FIG. 4 or the collapsible bag type shown in FIG. 6. After the cartridge is mounted, the casing 34 is replaced on the metering head by means of its screw threading, the attached water tap 14 is turned on, and the trigger 46 is depressed to cause the flow of water from the tap to enter the metering head. The entering water separates into two paths of flow, one portion thereof passing through the water duct 24 to fill the interior of the receptacle 34, and the remaining portion passing through the main bore 18 and the chemical mixing chamber 32 to the nozzle 42.

As previously indicated, the high pressure water flow eminating from the high pressure side 20 of the main bore 18, and flowing into the receptacle 34 via the water duct 24, instantaneously exerts a pressure upon the liquid chemical contained either within the piston cylinder 28 or within the compressible bag 108. The pressure applied to the piston 38 (FIGS. 1 and 4), or to the compressible bag 108 (FIG. 6), by the water flow at the high pressure region 20 of bore 18 is greater than the pressure at the low pressure region 22, so that the liquid chemical in container 28 or in bag 108 is ejected in a steady, regulated flow from the cartridge nozzle orifice 40 into the mixing chamber 32 where it is thoroughly mixed with the swirling water passing through the mixing chamber and the mixture is then discharged through the metering head nozzle 42. This arrangement provides precise metering of the liquid chemical, the latter being dispensed in a quantity and at a ratio which is exactly proportional to the amount of water which is flowing through the metering head main bore 18. The mixing ratio is determined solely by the size of the orifice 40 in the nozzle 30 of the disposable cartridge 12, and is always constant, regardless of the pressure of the water flowing from tap 14. Thus, while the water pressure may vary from time to time, the ratio of the chemical liquid dispensed to the volume of water flowing through the mixing chamber 32, is always precisely the same.

The dispenser apparatus of the present invention is particularly adapted to dispense a liquid-chemical mixture in a "micro-dispensing" proportion, that is in a ratio of small unit parts of liquid chemical per million parts of water. Thus, for some micro-dispensing applications, it may be essential to provide a mixture consisting of 200 parts of liquid chemical per million parts of water. In this case, the orifice 40 in the cartridge nozzle 30 is precisely dimensioned with a suitable small diameter. In other applications, a high ratio of, for example, 2000 p.p.m. (parts per million) of liquid chemical may be required for the mixture, in which case the nozzle of the cartridge is provided with a corresponding larger diameter outlet orifice. Since the cartridges are replaced and disposable, they may be made commercially available with a variety of different size nozzle orifices, so that the manufacturer may select the proper cartridge orifice in relation to the parts-per-million dispensing rate required by the chemical.

It will be appreciated that, after a spraying operation where liquid chemical still remains in the cartridge 12, the partially-filled cartridge may be removed from the metering head 16 and stored at a remote location for future use. For this purpose, the cartridge may be supplied with a screw cap (not shown) which is removably attachable to the threaded cartridge nozzle 30 to cover over the same and prevent spilling or evaporation of the contained liquid chemical. It will also be appreciated that the liquid chemical is confined within the interior of the cartridge 12, so that the latter may be freely handled by the user in insertion, removal or replacement thereof, without danger of the contained chemical contacting the user's hands. This is of particular importance where the contained concentrated chemical is toxic, caustic or the like.

The pressure casing 34 is preferably in the form of a jar made of glass or transparent plastic. The cartridge outer container 28, 28*a* is also made of transparent material, preferably plastic. Thus, the interior of the container 28 may be viewed by the user through the transparent walls, to check periodically upon the amount of liquid chemical remaining, and the cartridge may be replaced immediately when its contained chemical becomes depleted.

In the embodiment shown herein, the fluid dispensing assembly is illustrated as being of the hand-held, manually-operable sprinkler type. It is to be understood, however, that the assembly may be incorporated in an automatic sprinkler system, in which case the metering head 16, instead of having the built-in nozzle 42, would be connected by a hose to a remote sprinkler. The dispensing assembly could also be incorporated in a commercial sprinkler system of the type used to spray crops, and consisting of large numbers of sprinklers arranged in rows. In either instance, the micro-dispensing chemical proportioning and mixing capabilities of the dispensing assembly will be as effective as that heretofore described.

While preferred embodiments of the invention have been shown and described, it is obvious that numerous omissions, changes and additions may be made in such embodiments without departing from the spirit and scope of the invention.

What is claimed is:

1. Apparatus for diluting and feeding liquid concentrate for treatment of plants, for use with a source of water under pressure and liquid discharge means, said apparatus comprising a dispenser member and a disposable cartridge removably mounted on said dispenser member, said disposable cartridge including a rigid outer wall, a volume-reducing chamber formed in part by a pressure-sensitive member and containing a selected supply of liquid concentrate, and a rigid nozzle portion at one end of said rigid outer wall and communicating with the contained liquid concentrate, said dispenser member comprising a metering head, and a hollow casing removably mounted on said metering head, said metering head having a water inlet opening adapted to be connected to said source of water, a water outlet opening adapted to be connected to said liquid discharge means, and a water conduit interconnecting said water inlet and outlet openings and comprising a through bore having a high pressure end communicating with said inlet opening, a low pressure end communicating with said outlet opening, and a mixing chamber between said low pressure end and high pressure end, said metering head also having a first auxiliary fluid conduit communicating with the high pressure end of said through bore and with the interior of said hollow casing, a second auxiliary fluid conduit communicating with said mixing chamber, and means for mounting said disposable cartridge on said metering head by insertion of said rigid nozzle portion into said second auxiliary fluid conduit to a mounted position in which said disposable cartridge is suspended within said hollow casing and said outlet aperture communicates with said mixing chamber, whereby water under pressure supplied by said water source flows in a first path through said water conduit and through the mixing chamber thereof to said water outlet opening, and in a second path to the interior of said hollow casing, thereby filling said hollow casing and engaging the pressure-sensitive member of said disposable cartridge to feed the contained liquid concentrate therein through said outlet aperture into said mixing chamber, said outlet aperture in said rigid nozzle being precisely dimensioned with a diameter sufficiently small to dispense liquid concentrate to mix with the stream of water flowing in said first path through said mixing chamber in a precise pre-selected micro-dispensing amount of parts of concentrate per million parts of water, regardless of variations in the pressure of the water supplied by said water source.

2. Apparatus according to claim 1 in which said through bore also includes a helical flow path upstream of said mixing chamber, whereby the stream of water leaving said high pressure end enters said mixing chamber in a swirling liquid path for mixing with the liquid concentrate fed by said volume-reducing chamber.

3. Apparatus according to claim 2 in which said helical flow path comprises a cylindrical shell mounted in said through bore and having at least one spiral groove formed therein, and a block inserted within said shell and abutting the inner periphery thereof to restrict passage of the water stream to said spiral groove.

4. Apparatus according to claim 1 in which said water conduit also includes a flow restriction between said high pressure end of said through bore and said mixing chamber, said flow restriction being adapted to provide a resistance to flow in said through bore, causing a substantial pressure drop between said high pressure end and said mixing chamber.

5. Apparatus according to claim 1 in which said second auxiliary fluid conduit is internally threaded and in which said nozzle is externally threaded for removable mounting of said nozzle within said second auxiliary fluid conduit.

6. Apparatus according to claim 1 in which said disposable cartridge comprises a piston cylinder containing a supply of liquid concentrate and having an open bottom end, and a slidable piston mounted in said cylinder and overlying said open bottom end.

7. Apparatus according to claim 1 in which said pressure-sensitive member comprises a compressible bag made of pliable material secured to said nozzle.

8. Apparatus according to claim 1 in which said metering head has a threaded depending annular flange and said hollow casing comprises a jar having a threaded top end sized to be received by the threading of said annular flange, whereby said jar is removably mounted on said metering head enclosing the mounted disposable cartridge and in communication with the high pressure side of said through bore through said first auxiliary fluid conduit.

9. Apparatus according to claim 1 in which said hollow casing and the rigid outer wall of said volume reducing chamber are made of transparent material whereby the interior of the disposable cartridge may be viewed from the exterior of said apparatus to determine the amount of liquid concentrate remaining therein.

* * * * *